US005343277A

United States Patent [19]

Rooijakkers et al.

[11] Patent Number: 5,343,277

[45] Date of Patent: Aug. 30, 1994

[54] CLEANING SYSTEM FOR AN IMAGE TRANSFER DEVICE

[75] Inventors: Johannes P. J. C. Rooijakkers, Veldhoven; Andreas M. G. Bongers, Ittervoort; Gerardus J. Vosbeek, Velden, all of Netherlands

[73] Assignee: OCE-Nederland, B.V., Ma Venlo, Netherlands

[21] Appl. No.: 926,027

[22] Filed: Aug. 7, 1992

[30] Foreign Application Priority Data

Aug. 16, 1991 [NL] Netherlands ..... 9101395

[51] Int. Cl.[5] ..... G03G 21/00

[52] U.S. Cl. ..... 355/271; 355/215; 355/274; 355/296

[58] Field of Search ..... 355/271, 277, 279, 274, 355/215, 296–299; 15/256.5, 256.51, 256.52

[56] References Cited

U.S. PATENT DOCUMENTS

| | | | |
|---|---|---|---|
| 3,851,965 | 12/1974 | Furuichi et al. | 355/296 X |
| 3,929,095 | 12/1975 | Thettu . | |
| 4,453,820 | 6/1984 | Suzuki | 219/216 X |
| 4,588,279 | 5/1986 | Fukuchi et al. | 355/296 X |
| 4,607,947 | 8/1986 | Ensing et al. . | |
| 4,657,373 | 4/1987 | Winthaegen et al. . | |
| 4,796,048 | 1/1989 | Bean | 355/271 X |
| 4,959,691 | 9/1990 | Satoh | 355/246 |
| 5,150,161 | 9/1992 | Bujese | 355/271 X |

FOREIGN PATENT DOCUMENTS 57-22273 5/1982 Japan .

OTHER PUBLICATIONS

Patent Abstracts of Japan, vol. 6, No. 84 (P-117) (962) 22 May 1982 and JP-A-57-22273 (Ricoh K.K.) 5 Feb. 1982, abstract only.

*Primary Examiner*—A. T. Grimley
*Assistant Examiner*—T. A. Dang
*Attorney, Agent, or Firm*—Birch, Stewart, Kolasch & Birch

[57] ABSTRACT

A device for the transfer of a toner image from an image forming medium via an intermediate element to a receiving material while thoroughly cleaning the intermediate element by a combination of a first cleaning member and a second cleaning member. The first cleaning member has a surface to which toner adheres better than to the intermediate and serves for removal of high-melting impurities. The second cleaning member is cooled in such a manner that low-melting impurities, which have not been removed by the first cleaning member, are picked up by the second cleaning member.

4 Claims, 2 Drawing Sheets

CLEANING SYSTEM FOR AN IMAGE TRANSFER DEVICE

BACKGROUND OF THE INVENTION

1. Field of the Invention

The present invention relates to an image transfer device, and more specifically to a device for the transfer of a toner image from an image forming medium to a receiving material, while thoroughly cleaning an intermediate image support.

2. Description of the Related Art

U.S. Pat. No. 4,607,947 describes a contact fixing device in which a toner image is transferred from an image forming medium to a heated intermediate. Subsequently, in a fixing zone in which the intermediate is in contact with a pressure member, the toner image is transferred to and simultaneously fixed on a receiving material being transported through the fixing zone. After the transfer of the toner image to the receiving material, the intermediate is cleaned by a cleaning member having a cleaning surface to which toner adheres better than to the intermediate. This type of cleaning member functions well in removing high-melting impurities, such as residues of toner material and also paper dust. However, low-melting impurities, such as plastic filling agents occurring in receiving paper and also dust particles of plastic receiving materials, are not at all or only partly picked up by the known cleaning member. When such impurities are not completely removed from the intermediate, they will reach the first transfer zone between the image forming medium and the intermediate, where they may be transferred to the image forming medium. This causes a disturbance of the image forming and, in the end, faulty images in the copy on the receiving material.

SUMMARY OF THE INVENTION

Therefore, it is an object of the present invention to provide an image transfer apparatus which will overcome the above noted disadvantages.

A further object of the present invention is to provide a cleaning system for an image transfer device in the transfer of a toner image from an image forming medium to a receiving material.

According to the present invention, a device for the transfer of a toner image from an image forming medium to a receiving material comprises an endless, movable intermediate which is in contact with an image forming medium in a first transfer zone, heating elements for heating the toner image on the intermediate, a pressure member that is in contact with the intermediate in a second transfer zone, conveying means to convey a receiving material through the second transfer zone, and a first cleaning member with a cleaning surface to which toner adheres better than to the intermediate, which first cleaning member is in contact with the surface of the intermediate between the second transfer zone and the first transfer zone. The image transfer device is further provided with a second cleaning member which is in contact with the surface of the intermediate between the first cleaning member and the first transfer zone, and with a cooling means to withdraw heat energy from the second cleaning member, the cooling means being thus adjusted so that the surface of the second cleaning member is kept at such a low temperature, at least closely before the contact zone with the intermediate, viewed in the transport direction, that impurities which have not been removed by the first cleaning member will be picked up by the second cleaning member. It appears that excellent results are achieved when the surface of the second cleaning member is kept at a temperature below 70° C. In this way, it is assured that the low-melting impurities which are transformed into a molten state by the contact with the heated intermediate, are cooled down in such a way by the cooled second cleaning member, that the cohesion of the impurity particles is greater than the adhesion with respect to the surface of the intermediate. As a result, the impurities can be completely picked up by the second cleaning member, and no residue of impurities is conveyed to the image forming medium.

It appears that effective removal of all occurring impurities cannot, due to their variety of character, be effected by one cleaning member. A combination of a first cleaning member, optimized for high-melting impurities, and a second cleaning member, optimized for low-melting impurities does, however, yield excellent results. In this instance, the sequence mentioned above is of great importance for the cleaning effect, since in the reverse sequence the cleaning member for low-melting impurities will also pick up part of the high-melting impurities and consequently no longer would function optimally for the low-melting impurities.

According to a first embodiment of the invention, the second cleaning member consists of a hollow, metal roller which is connected to a conveying system, by which a cooling agent may be conveyed through the hollow roller. In this way, effective provisions are made for a cooled, second cleaning member.

In an alternate embodiment of the invention, a so-called heat pipe is used as the second cleaning member, providing effective cooling and, moreover, a very uniform temperature over the whole length of the second cleaning member.

BRIEF DESCRIPTION OF THE DRAWINGS

The invention will now be explained in detail by means of the attached figures, wherein.

DETAILED DISCUSSION OF THE INVENTION

Figure 1:
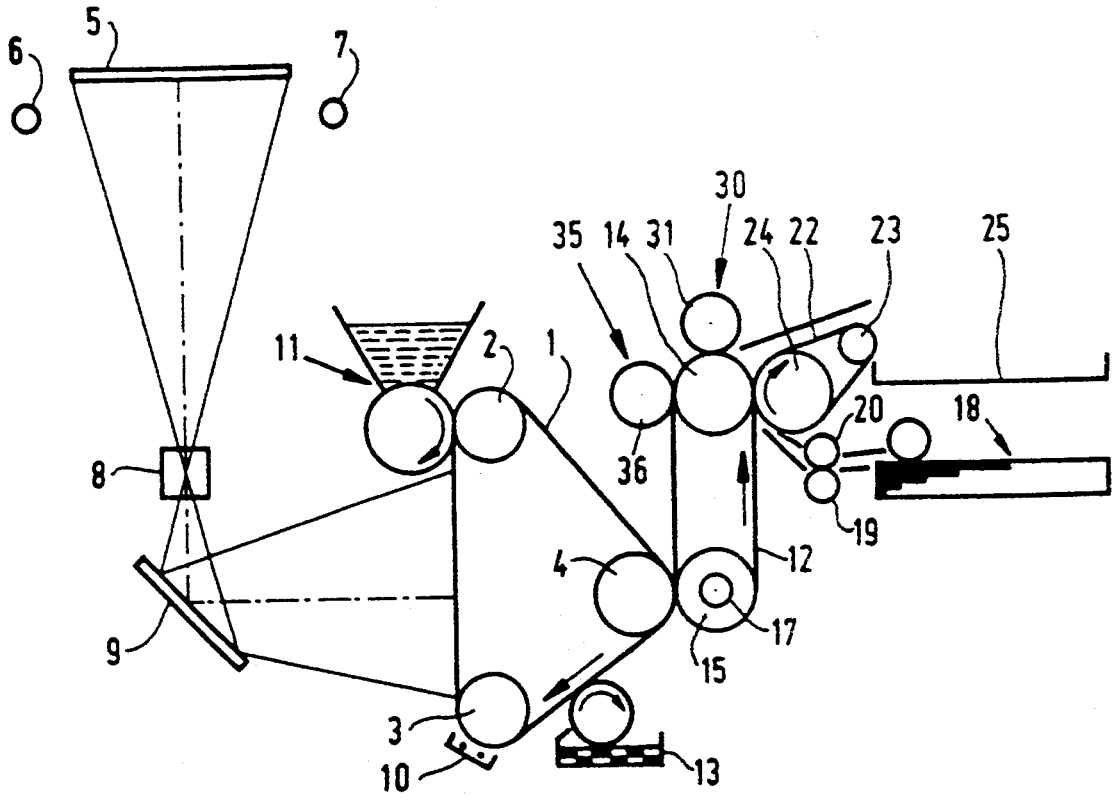
FIG. 1 is a schematic cross section of a device according to the invention.

The imaging device depicted in FIG. 1 is provided with an image forming medium or endless photoconductive belt 1 which, by means of drive or guide rollers 2, 3 and 4, is advanced at an even rate. The image of an original positioned on a platen 5 is projected onto the belt 1 by means of flash bulbs 6 and 7, a lens 8 and a mirror 9, the belt having been charged electrostatically by a corona unit 10. The latent charge image, formed on belt 1 by the flash exposure, is developed into a toner image through a magnetic brush device 11, which, in turn, under pressure in a first transfer zone, is brought into contact with an endless intermediate belt 12, that is made of or covered with a soft, resilient and heat resistant material, such as silicone rubber. Here, the toner image is transferred from the image forming medium or belt 1 onto the intermediate belt 12 by forces of adhesion.

After this image transfer at the first transfer zone possible residual images are removed from belt 1 by means of a cleaning device 13, after which the photoconductive belt 1 is ready for imaging once again.

The intermediate belt 12 is stretched above drive and guide rollers 14 and 15, the intermediate belt 12 being heated to a temperature above the softening temperature of the toner powder, e.g. by an infrared heater 17, arranged inside roller 15. While belt 12 with the toner image on it is advanced, the toner image becomes sticky through heating. In a second transfer zone, the sticky toner image is then transferred to and simultaneously fixed under pressure onto a sheet of receiving material, which is fed from the storage tray 18 via rollers 19 and 20. Finally, the copy produced in this way is deposited into the receiving tray 25 via belt 22, which is stretched about rollers 23 and 24.

While the toner powder is represented as being softened by the infrared heater 17, any suitable heating means may be used to soften and tackify the toner image. For examle, the toner image may be heated by directly radiating the toner image on the intermediate member by means of an infrared heater opposing the intermediate member.

A first cleaning member 30 is pressed against the intermediate belt 12 following the second transfer zone, viewed in the transport direction, consisting of a freely rotatable roller 31 with a surface onto which toner material adheres better than to the intermediate belt 12. The freely rotatable roller 31 is driven by the intermediate belt 12.

The aforementioned better adherence onto the surface of roller 31 can be obtained for instance by providing roller 31 with a surface layer of adhesive material. As is known from U.S. Pat. No. 4,607,947 and U.S. Pat. No. 4,705,388, the adhesive surface layer can be achieved by covering roller 31 with a layer of thermoplastic powder, e.g. powder with the same composition as the toner powder by which the toner images are made on the photoconductive belt 1, and by heating roller 31 to a temperature above the softening temperature of the thermoplastic powder. Also, an embodiment of roller 31 with a metal top layer which is heated to a temperature above the softening temperature of the toner powder used for image forming, suffices to remove residual toner material from the intermediate belt 12.

The adjustment of the heater of the intermediate belt 12 or that of an embodiment of the first cleaning member 30 respectively, in which the roller 31 is heated, is chosen in such a way that the toner image or the residual toner respectively becomes sufficiently sticky to be transferred to the receiving material or the surface of roller 31, respectively. A good transfer of toner material in this instance is determined in that the adhesion between receiving material or surface of roller 31 respectively, and the sticky toner material is greater than the adhesion between the toner material and the surface of the intermediate belt 12. In addition, the temperature of the toner material may nevertheless not rise so high that the cohesion of the toner material decreases in a way that the adhesion with regard to the intermediate belt 12 becomes higher than the cohesion, and the toner material partly remains on belt 12. With such an adjustment of the heater(s), a good transfer of high-melting materials, like toner powder, is ensured.

In the second transfer zone, low-melting particles, like plastic filling agents from the receiving paper and dust particles of plastic receiving materials, can be released out of the receiving material and be transferred to the intermediate belt 12. In this way they build up and soil the intermediate, which impurities must be removed from the intermediate belt 12 in order to prevent subsequent image defects.

The first cleaning member 30 picks up such low-melting impurities only partly, because due to the chosen temperature setting, the temperature of these impurities reaches such a value that the cohesion of the material decreases and is overcome by the adhesion with respect to both the surface of roller 31 and the intermediate belt 12. In order to facilitate total removal of these low-melting impurities from the intermediate belt 12, the device according to the present invention is provided with a second cleaning member 35, e.g. in the form of a roller 36 which is in contact with the belt 12, after the first cleaning member 30, viewed in the direction of transport.

With the aid of a cooling means (not depicted in FIG. 1), roller 36 is cooled, so that the low-melting impurities in the contact zone between roller 36 and the belt 12 are also cooled to a temperature level at which the impurity particles stick sufficiently to the surface of roller 36 and the cohesion of the particles is adequate to overcome the adhesive forces of the intermediate belt 12, so that the impurity particles consequently are picked up completely by roller 36.

It appears that with the most frequently occurring materials that make up the low-melting impurities, a good cleaning action is obtained when the cooling means is adjusted in such a way that the surface temperature of roller 36 is kept below 70° C, and preferably below 50° C, at least just before the contact zone with belt 12.

Any means known in technology to extract heat from roller 36 either from within or outside may be used as a cooling means. Excellent results are achieved by providing roller 36 as a hollow roller with good heat conductive qualities (e.g. metal), and to connect it to a conventional cooling circuit, by which a cooling agent is transported through the hollow roller. The capacity to be removed by the cooling means depends inter alia on the time the impurity particles remain in the contact zone between the second cleaning member 35 and the intermediate belt 12, and further on the difference between the temperature adjustment of the intermediate belt 12 and that of the second cleaning member 35.

It will be clear to the person skilled in the art that, as a means to adjust the cooling means to remove the demanded capacity, he has at his disposal the output of the cooling circuit, the choice of the cooling agent and the choice of the material of roller 36 (heat conductivity). Obviously, there is also the possibility to control the cooling means in an active way, by measuring the temperature of the surface of the second cleaning member 35 by traditional means, and to use this measuring signal as an input signal for a control circuit by which the output of the cooling system is controlled. In addition, an evenly spread cooling (temperature distribution) over the length of the roller 36 will have a positive influence on the capacity to be eliminated, since with an uneven cooling the warmest part of the roller 36 must be kept below the desired temperature, and the rest of roller 36 would unnecessarily have to be cooled down further. The cleaning member 35 needs to be in contact with the intermediate belt 12 only during the copying cycle and some time span thereafter, which may be assumed to be evident. So as to prevent unnecessary loss of energy, it is advisable to raise the cleaning member 35 from belt 12 when copying is not in process, by customary means.

Excellent results concerning the evenness of cooling are obtained by applying a so-called heat pipe as the second cleaning member 35. Furthermore, combinations of a heat pipe and a hollow cooling roller may be used, such as a cooling roller arranged within a heat pipe or a heat pipe arranged inside a cooling roller, in order to remove heat energy. As a heat pipe, a commercially obtainable heat pipe may be used, the capacity to be removed determining, of course, the kind to be chosen.

Figure 2:
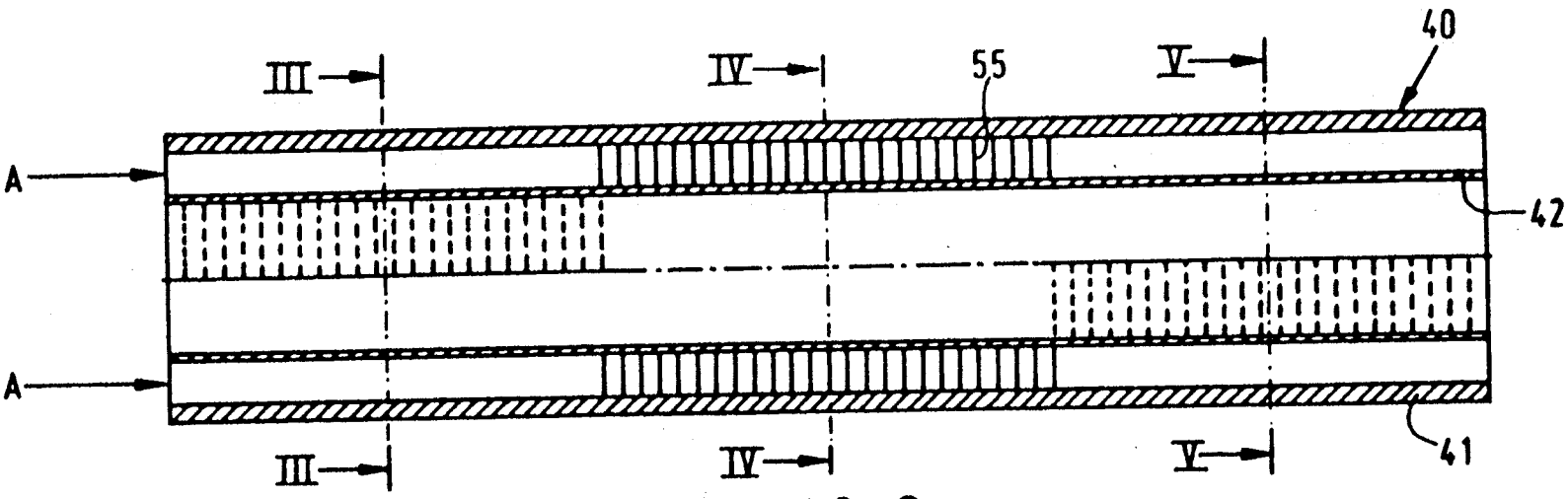
FIG. 2 is a schematic cross section of a cleaning roller for use in the device according to the invention.
Figure 4:
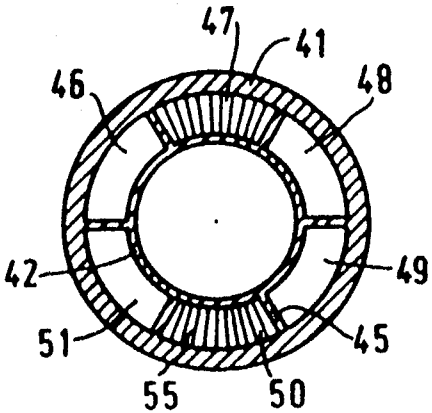
FIG. 4 is a cross section line IV—IV in FIG. 2.
Figure 5:
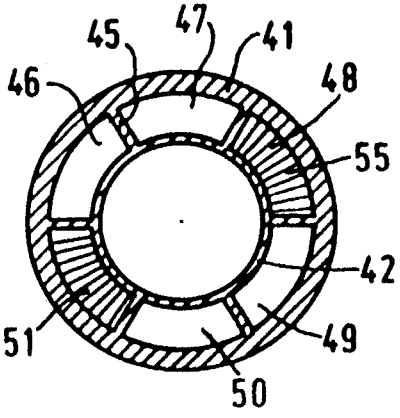
FIG. 5 is a cross section along line V—V in FIG. 2.
Figure 3:
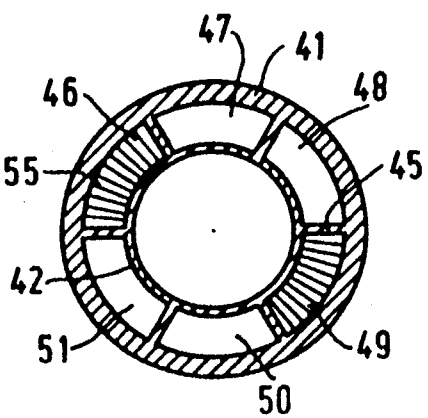
FIG. 3 is a cross section along line III—III in FIG. 2.

Another embodiment of a hollow metal roller to be used as cleaning roller 36, with which a very fine evenness in temperature is achieved, is represented in FIGS. 2–5. The cleaning roller 40 consists of two concentric pipes 41 and 42 that are connected to each other via six partitions 45 which extend over the full length of the cleaning roller 40. Thus, in the space between pipes 41 and 42, six cylinder segments 46, 47, 48, 49, 50 and 51 are formed, as can be seen in FIGS. 3–5. These cylinder segments 46 to 51 possess cooling ribs 55 only for one third of the length of cleaning roller 40, locally enlarging the cooling surface.

As can be seen in FIGS. 3 to 5, the arrangement of the cooling ribs 55 in the circumferential direction varies for each cylinder segment. In the left-hand part of cleaning roller 40, as seen in FIG. 2, the cooling ribs 55 are arranged in the cylinder segments 46 and 49 only (FIG. 3), in the central part of roller 40 only in the cylinder segments 47 and 50 (FIG. 4), and in the right-hand part of the roller only in the cylinder segments 48 and 51 (FIG. 5). This results in a better distribution of the cooling effect of roller 40 over the length of roller 40 than with a plain, hollow roller through which a cooling agent is transported. Note that in that situation, the temperature of the cooling agent is low at the feeding side, rendering a great cooling effect. At the discharge side of the hollow roller, the cooling agent has been warmed up so much that its cooling capacity there has become significantly lower than at the feeding side.

The design according to FIGS. 2 to 5 permits a considerably more even cooling effect. A cooling agent which is supplied in the direction of arrows A in FIG. 2 into the cylinder segments 46-51 undergoes a different cooling pattern per different segment. The cooling agent (e.g. air or water) which is fed into the cylinder segments 48 and 51 picks up but little heat in the left-hand and central part of roller 40 (as viewed in FIG. 2), so that the cooling agent has not been heated up considerably in the right-hand part of roller 40, and can thus exert there substantial cooling effect in the part of the roller which possesses the cooling ribs 55.

Similarly, for the cylinder segments 46 and 49, the greatest cooling effect is exercised in the left-hand part of roller 40, and for the cylinder segments 47 and 50 in the central part of roller 40. Thus, a very even distribution of the cooling effect is accomplished, resulting in an even temperature distribution of cleaning roller 40 which is used as a second cleaning member 35. The capacity to be removed is restricted amply by this even cooling effect.

In the foregoing description, rollers 36 and 40 have been mentioned as possible embodiments of the second cleaning member 35, but the invention is not limited thereto. Alternately, an endless belt must be considered as another embodiment of the cleaning member 35.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An imaging device for transferring a toner image to a receiving material comprising an image forming medium, means for developing a toner image on said image forming medium an endless intermediate movable in a transport direction which intermediate is in contact with said image forming medium in a first transfer zone such that said toner image is transferred to said movable intermediate, means for heating said toner image on said intermediate, a pressure member in contact with said intermediate in a second transfer zone for transferring said toner image from said intermediate to said receiving material, conveying means for conveying said receiving material through said second transfer zone, a first cleaning member serving to substantially remove high-melt impurities, provided with a cleaning surface to which toner adheres better than to said intermediate, which first cleaning member is in contact with a surface of said intermediate following said second transfer zone, a second cleaning member serving to substantially remove low-melt impurities, which is in contact with said surface of said intermediate between said first cleaning member and said first transfer zone, and cooling means to withdraw heat energy from said second cleaning member, said cooling means being adjusted such that a surface of said second cleaning member is kept at such a low temperature, at least just before a contact zone with said intermediate, viewed in said transport direction, so that impurities, which have not been removed by said first cleaning member, will be picked up by said second cleaning member.

2. A device according to claim 1, further including means for adjusting said cooling means in such a way that said surface of said second cleaning member is kept at a temperature below 70° C.

3. A device according to claims 1 or 2, wherein said second cleaning member consists of a hollow, metal roller which is connected to a transport system by which a cooling agent can be transported through said hollow metal roller.

4. A device according to claims 1 or 2, wherein said second cleaning member consists of a heat pipe.

* * * * *